US010508511B2

(12) United States Patent
Williamson

(10) Patent No.: US 10,508,511 B2
(45) Date of Patent: Dec. 17, 2019

(54) ROTARY ACTUATOR FOR ACTUATING MECHANICALLY OPERATED INFLOW CONTROL DEVICES

(71) Applicant: Halliburton Energy Services, Inc., Houston, TX (US)

(72) Inventor: Jimmie R. Williamson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 193 days.

(21) Appl. No.: 15/553,888

(22) PCT Filed: Apr. 17, 2015

(86) PCT No.: PCT/US2015/026515

§ 371 (c)(1),
(2) Date: Aug. 25, 2017

(87) PCT Pub. No.: WO2016/167811

PCT Pub. Date: Oct. 20, 2016

(65) Prior Publication Data

US 2018/0038202 A1 Feb. 8, 2018

(51) Int. Cl.
*E21B 34/12* (2006.01)
*E21B 47/09* (2012.01)
(Continued)

(52) U.S. Cl.
CPC ..... *E21B 34/12* (2013.01); *E21B 47/09* (2013.01); *E21B 47/10* (2013.01); *E21B 49/08* (2013.01);
(Continued)

(58) Field of Classification Search
CPC .... E21B 2034/007; E21B 34/12; E21B 34/14; E21B 43/14; E21B 47/09; E21B 47/10; E21B 49/08
See application file for complete search history.

(56) References Cited

U.S. PATENT DOCUMENTS 6,333,699 B1 * 12/2001 Zierolf ..... E21B 17/006 166/254.2
2005/0224233 A1 * 10/2005 Johnson ..... E21B 23/01 166/382

(Continued)

FOREIGN PATENT DOCUMENTS

WO 2011133909 A1 10/2011

OTHER PUBLICATIONS

International Search Report and Written Opinion dated Jan. 15, 2016; International PCT Application No. PCT/US2015/026515.

*Primary Examiner* — Caroline N Butcher
(74) *Attorney, Agent, or Firm* — McGuireWoods LLP

(57) ABSTRACT

A rotary actuator operates an inflow control device in a tubing string. The rotary actuator includes a stationary member, a drive member, and a locator device, where the locator device anchors the rotary actuator at a predetermined location in a tubing string. The drive member rotates relative to the stationary member, and operates the inflow control device. A method of actuating an inflow control device with a rotary actuator, the method comprising: conveying the rotary actuator to a predetermined location in the tubing string, engaging the engagement members with a profile, thereby preventing further movement of the rotary actuator into the tubing string, and rotating the drive member relative to the stationary member, thereby actuating the inflow control device.

18 Claims, 8 Drawing Sheets

(51) Int. Cl.

| | |
|---|---|
| ***E21B 47/10*** | (2012.01) |
| ***E21B 49/08*** | (2006.01) |
| *E21B 43/14* | (2006.01) |
| *E21B 34/00* | (2006.01) |

(52) U.S. Cl.
CPC ..... *E21B 43/14* (2013.01); *E21B 2034/007* (2013.01)

(56) References Cited

U.S. PATENT DOCUMENTS

| | | | | |
|---|---|---|---|---|
| 2008/0035350 | A1 | 2/2008 | Henriksen et al. | |
| 2010/0212966 | A1 | 8/2010 | Hall et al. | |
| 2011/0146975 | A1* | 6/2011 | O'Malley ..... | E21B 34/14<br>166/250.15 |
| 2013/0255962 | A1* | 10/2013 | Williamson ..... | E21B 34/06<br>166/373 |
| 2014/0251627 | A1 | 9/2014 | Holderman et al. | |
| 2015/0034334 | A1 | 2/2015 | Hallundbæk et al. | |
| 2016/0282512 | A1* | 9/2016 | Donderici ..... | E21B 43/26 |

* cited by examiner

ROTARY ACTUATOR FOR ACTUATING MECHANICALLY OPERATED INFLOW CONTROL DEVICES

This is a 371 national stage application of International Patent Application No. PCT/US2015/026515 filed Apr. 17, 2015, the disclosure of which is incorporated by reference herein in its entirety.

TECHNICAL FIELD

A rotary actuator and methods of operating mechanically operated inflow control devices are provided. The rotary actuator includes torque keys that are capable of rotating a member of an inflow control device relative to a tubing string, thereby actuating the inflow control device. According to certain embodiments, the rotary actuator is used in an oil or gas well operation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
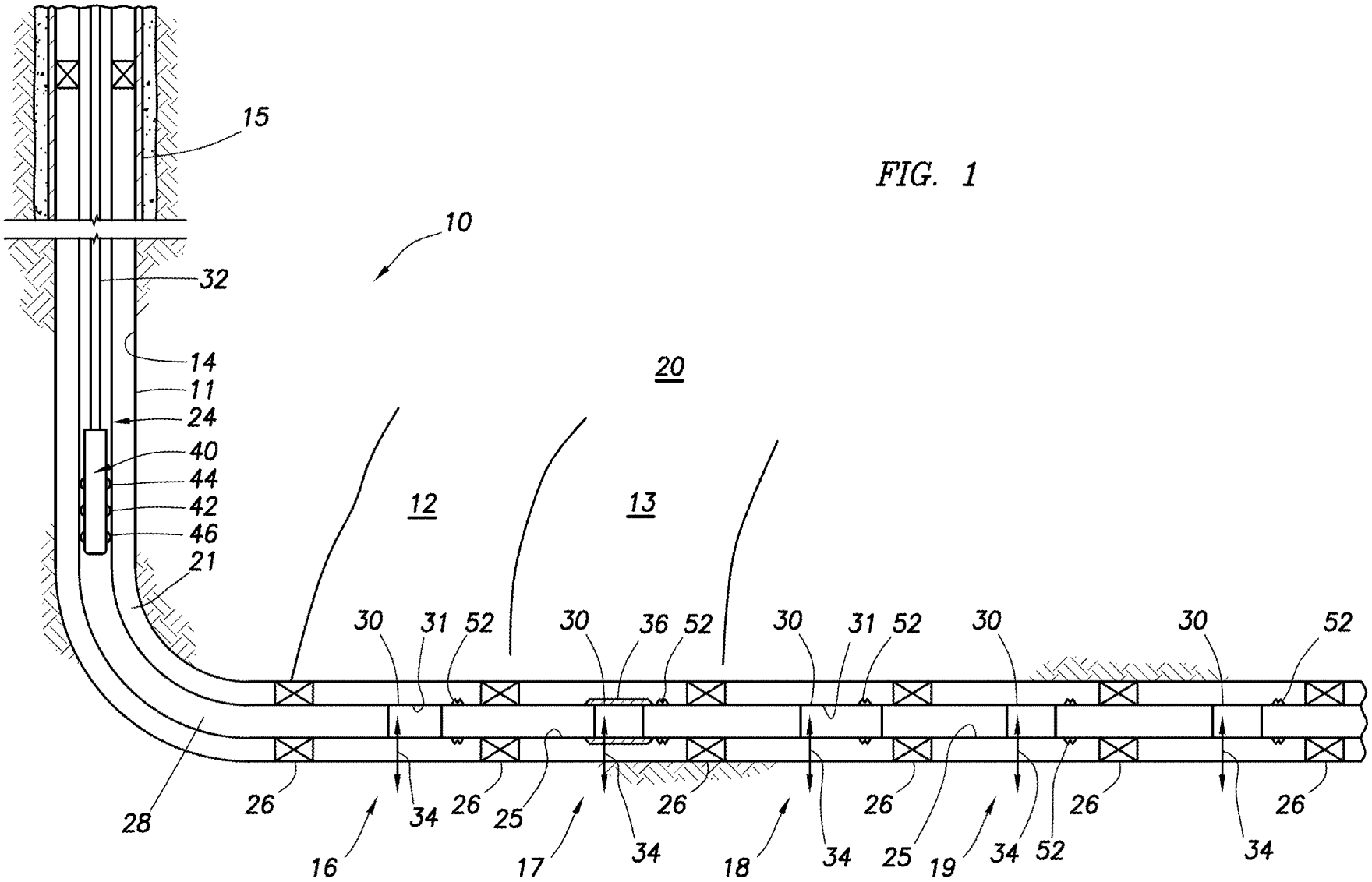
FIG. 1 depicts a schematic diagram of a well system containing a rotary actuator that can individually control multiple inflow control devices of the well system.

Oil and gas hydrocarbons are naturally occurring in some subterranean formations. In the oil and gas industry, a subterranean formation containing oil or gas is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from a reservoir is called a reservoir fluid. As used herein, a "fluid" is a substance having a continuous phase that tends to flow and to conform to the outline of its container when the substance is tested at a temperature of 71° F. (22° C.) and a pressure of one atmosphere "atm" (0.1 megapascals "MPa"). A fluid can be a liquid or gas.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. The well can also include multiple wellbores, such as a main wellbore and lateral wellbores. As used herein, the term "wellbore" also includes a main wellbore as well as lateral wellbores that branch off from the main wellbore or from other lateral wellbores. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a well" means and includes into any portion of the well, including into the wellbore or into the near-wellbore region via the wellbore.

In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

As used herein, the relative term "downstream" means at a location closer to a wellhead, and "upstream" means at a location further away from the wellhead. As used herein, the phrase "rotationally fixed" means that one item is substantially prevented from rotating relative to another item. As used herein, the phrase "substantially prevented" means that a slight relative rotation from approximately 0 to 10 degrees between the two items can occur while still being rotationally fixed.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. Each zone of the formation can be isolated within the wellbore via the use of packers or other similar devices.

It is often desirable to produce a reservoir fluid from multiples zones of a formation. However, there are problems associated with producing from or injecting into multiple formation zones. A zone with higher permeability can produce fluid at a higher rate when compared to another zone with reduced permeability. Higher flow rate from one zone may cause accelerated degradation of the wellbore components related to that zone due to higher fluid velocities. It may be desirable to reduce flow velocity from the high permeability zone by increasing flow restrictions to the inflow of fluid from the zone into the tubing string. Additionally, it may be desirable to increase flow velocity from the low permeability zone by decreasing flow restrictions to the inflow of fluid from the zone into the tubing string. Also, some zones may produce more water than other zones. In oil and gas wells, it is desirable to minimize the amount of water being produced with the oil and/or gas. In injection wells, it is often desirable to control the injection rate of a fluid (e.g., steam) into each zone to provide a better distribution of the fluid being injected into the zones.

Fluid flow from the tubing string into a subterranean formation (e.g., injection) or fluid flow from the subterranean formation and into the tubing string (e.g., production) can be regulated by controlling at least one inflow control device in each zone to selectively restrict fluid flow between the tubing string and the subterranean formation. However, each inflow control device normally requires control lines connected directly to the device for control of the device. With multiple zones, an increased number of inflow control devices can be required, thereby increasing the number of control lines needed. Additional lines can present even more problems for the well system, by requiring more penetrations of annular seals (e.g., packers), having an increased potential for damage, etc. Therefore, there is a need to provide control for the inflow control devices in a multi-zone well system, without incurring the problems caused by the additional control lines.

It has been discovered that a rotary actuator can mechanically adjust the flow rate of fluid flow through the inflow control devices without the need for control lines connected directly to the devices. Mechanically actuated inflow control devices do not necessarily require direct connection to control lines for actuation, and these inflow control devices can be much less complicated than hydraulically, electrically, or optically actuated inflow control devices. As used herein, "mechanically actuated" refers to a device being actuated by the application of a mechanical force such as a rotational and/or longitudinal displacement force that acts on a component of the device and without electrical energy, optical energy, magnetic coupling, or an increased fluid pressure being applied to the device.

According to certain embodiments, a rotary actuator that adjusts an inflow control device in a tubing string is provided, the rotary actuator including, (A) a stationary member, (B) a drive member, where the drive member rotates relative to the stationary member, and the inflow control device is operated in response to the rotation of the drive member, and (C) a locator device that anchors the rotary actuator at a predetermined location in a tubing string.

According to other embodiments, a method of adjusting an inflow control device in a tubing string with a rotary actuator is provided. The methods can include the steps of conveying the rotary actuator to a predetermined location in the tubing string, where the rotary actuator includes: (A) a stationary member, (B) a drive member, and (C) a locator device with engagement members. Engaging the engagement members with a profile in the inflow control device and/or the tubing string thereby prevents longitudinal movement of the rotary actuator into the tubing string, and rotating the drive member relative to the stationary member, thereby actuating the inflow control device.

Any discussion of the embodiments regarding the rotary actuator or any component related to the rotary actuator is intended to apply to all of the apparatus and method embodiments.

Turning to the Figures, FIG. 1 depicts a well system 10. The well system 10 can include at least one wellbore 11. The subterranean formation 20 can be a portion of a reservoir or adjacent to a reservoir. The wellbore 11 can include a casing 15. A tubing string 24 with an internal flow passage 28 can be installed in the wellbore 11. The subterranean formation 20 can have at least a first zone 12 and a second zone 13.

The well system 10 can include at least a first wellbore interval 16 and a second wellbore interval 17. The well system 10 can also include more than two wellbore intervals, for example, the well system 10 can further include a third wellbore interval 18, a fourth wellbore interval 19, and so on. At least one wellbore interval can correspond to a zone of the subterranean formation 20. By way of example, the first wellbore interval 16 can correspond to the first zone 12.

The well system 10 can include one or more packers 26. The packers 26 can create the wellbore intervals and isolate each zone of the subterranean formation 20. The packers 26 can prevent fluid flow between one or more wellbore intervals (e.g., between the first wellbore interval 16 and the second wellbore interval 17) via an annulus 21.

The rotary actuator 40 can travel through the longitudinal flow passage 28 of the tubing string 24 on a conveyance 32 to each of the inflow control devices 30 and actuate each device 30 through mechanical manipulations. As used herein, "conveyance" refers to a means of transporting the rotary actuator 40 through the tubing string 24, such as coiled tubing, a wireline, a tractor system, a segmented tubing string, etc. Multiple inflow control devices 30 can be adjusted (e.g., actuated between open, closed, and partially open positions) during a single trip of the rotary actuator 40 into the wellbore 11. An inflow control device 30 can also be used to control fluid flow through a well screen 36 as indicated in wellbore interval 17.

It should be noted that the well system 10 illustrated in the drawings and described herein is merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a crossover valve assembly. By way of another example, cement may be used instead of, or in addition to, the packers 26 to provide zonal isolation.

The rotary actuator 40 can include a locator device 46 that locates the actuator 40 at a predetermined location within the tubing string 24. The predetermined location can be the location of a downhole tool (such as an inflow control device 30) in the tubing string 24. The rotary actuator 40 can also be positioned at the predetermined location by introducing the actuator 40 a predetermined distance into the tubing string, or by introducing the actuator through the tubing string until a sensor 60 (e.g., a radio frequency identification (RFID) read/write device 104) of the actuator 40 senses an identifier (e.g., an RFID device) of the downhole tool that matches an expected identifier, thereby verifying that the actuator is at the predetermined location.

When the locator device 46 is utilized, the rotary actuator 40 can be positioned in the tubing string 24 at the predetermined location, and can engage the locator device 46 with a profile 52 to anchor the actuator 40 at the predetermined location. As used herein "anchor" means that the item being anchored (e.g., the rotary actuator 40) is prevented from any further longitudinal movement upstream or further into the tubing string 24. However, longitudinal movement downstream or up and out of the tubing string 24 can be permitted. The profile 52 can be recesses formed in an inner wall 31 of the inflow control device 30 (as seen in interval 18) and/or in an inner wall 25 of the tubing string 24 (as seen in intervals 16, 17, 19).

When the rotary actuator 40 is at the predetermined location, the rotary actuator 40 uses a stationary member 44 and a drive member 42 to impart rotational movement to a component of the inflow control device 30, thereby actuating the inflow control device 30 between open, closed, and/or partially open positions. The rotary actuator 40 can then be moved to another inflow control device 30 in the wellbore (either upstream or downstream) to actuate another inflow control device 30 between open, closed, and/or partially open configurations. This process can continue until all inflow control devices 30 are actuated to their desired configuration.

Referring now to FIGS. 2, 3A-B, and 4A-B, FIG. 2 depicts a more detailed cross-sectional view of the rotary actuator 40, and FIGS. 3A-B and 4A-B depict two possible inflow control devices 30 that can be controlled by the rotary actuator 40. The coupling 102 can be used to couple the rotary actuator 40 to the conveyance 32, which can be a coiled tubing, a wireline, a tractor system, a segmented tubing string, etc. When the wellbore 11 is generally vertical, then a coiled tubing and/or wireline conveyance 32 may be preferred. However, if the wellbore 11 is generally horizontal or at least a significant portion is horizontal, then a tractor system and/or a segmented tubing string conveyance 32 may be preferred.

The rotary actuator 40 can include a controller 62, a motor 66, at least one stationary member 44, and at least one drive member 42. The controller 62 can receive commands from a remote location, such as the earth's surface, drilling rig, etc., via wired or wireless telemetry. The controller 62 can interpret and execute the commands to operate the rotary actuator 40, which in turn can operate an inflow control device 30. The controller 62 can also receive sensor data from various sensors 60 (see FIG. 5A), such as temperature, pressure, fluid viscosity, fluid velocity, tool orientation, RFID identification, etc. and send this data to the remote location for processing.

This sensed data can be used to determine whether the rotary actuator 40 is at the predetermined location or not (e.g., reading the RFID device), whether the actuator 40 is at a correct azimuthal orientation (e.g., reading an inclinometer), environmental conditions at the predetermined location (e.g., reading temperature, pressure sensors), and what fluids are being produced or injected at the predetermined location by detecting at least one characteristic of the fluid at the predetermined location (e.g., reading temperature, pressure, fluid viscosity, fluid velocity sensors). The controller 62 can automatically actuate the inflow control device 30 at the predetermined location in response to the sensed data. For example, if the sensor data indicates water is being produced at the predetermined location, then the controller 62 can actuate the inflow control device 30 to a closed or partially closed position to prevent or reduce production of water from the respective wellbore interval (e.g., the first or second wellbore intervals 16, 17). The controller 62 can also be commanded from a remote location by an operator at the surface in response to the sensed data that was sent to the remote location for processing.

In operation, the rotary actuator 40 can be moved through the tubing string 24 (not shown in FIGS. 3A-B, 4A-B) to align the actuator 40 with an inflow control device 30. When positioned in the tubing string 24 at the predetermined location, a stationary member 44 can be engaged with a first recess 54 and a drive member 42 can be engaged with a second recess 56. The first recess 54 can extend radially outwardly from the inner wall 31 of the inflow control device 30 and is rotationally fixed to an outer housing 38 of the inflow control device 30, where the outer housing is rotationally fixed to the tubing string 24 (e.g., through threaded pin and box connections). Therefore, the stationary member 44 is substantially prevented from rotating relative to the tubing string 24. However, clearances between walls of the first recess 54 and the stationary member 44 can allow a slight relative rotation between the stationary member 44 and the first recess 54. When the stationary member 44 is rotated in a first direction and abuts a wall of the first recess 54, then any further rotation in the first direction is prevented. If the stationary member 44 is rotated in a second direction, which is opposite to the first direction, then the stationary member 44 can rotate relative to the first recess 54 until the member 44 abuts another wall of the first recess 54, thereby preventing any further rotation in the second direction. The relative rotation between the stationary member 44 and the first recess 54 will generally not exceed 10 degrees before the stationary member abuts a wall of the first recess 54, thereby preventing further relative rotation in that direction.

Figure 3B:
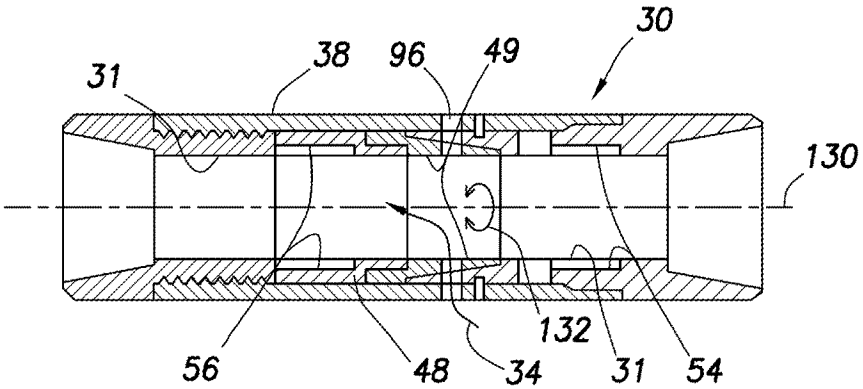
FIGS. 3A-B depict a partial cross-sectional view of an inflow control device that can be controlled by the rotary actuator.

The second recess 56 can be rotationally fixed to a closure member 48 of the inflow control device 30. The second recess 56 can be in an inner wall 49 of the closure member 48, where the second recess 56 extends radially outwardly from the inner wall 49. Rotation of the closure member 48 can actuate the inflow control device 30 between open, closed, and partially open positions. When the controller 62 is commanded to actuate the inflow control device 30, the controller 62 operates the motor and causes the rotor 69 to rotate about the axis 130 relative to the stator 68 as indicated by arrows 132 (FIGS. 3B, 4B). Since the drive member 42 is rotationally coupled to the rotor 69, the rotor's rotation causes the drive member 42 to also rotate about the axis 130. Furthermore, engagement of the drive member 42 with the second recess 56 causes the second recess 56 to rotate, thereby rotating the closure member 48 and actuating the inflow control device 30.

Figure 3A:
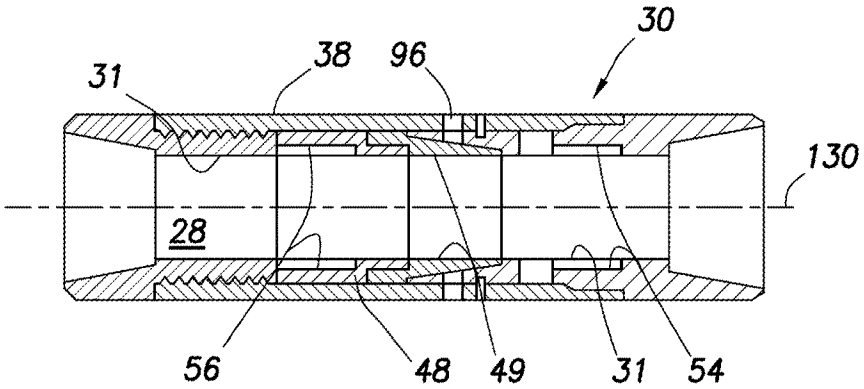
Figure 4A:
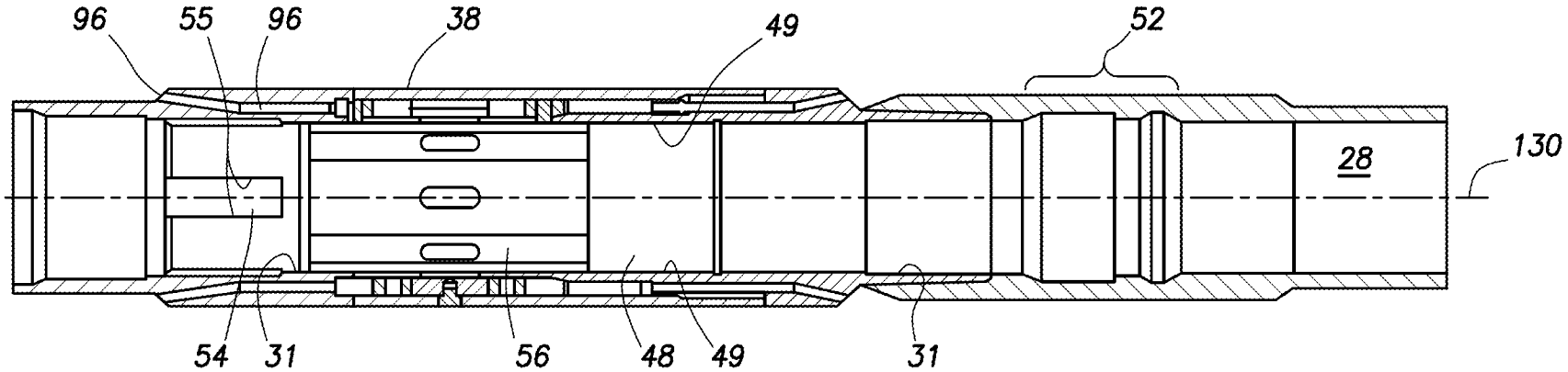
FIGS. 4A-B depict a cross-sectional view of another inflow control device that can be controlled by the rotary actuator.
Figure 4B:
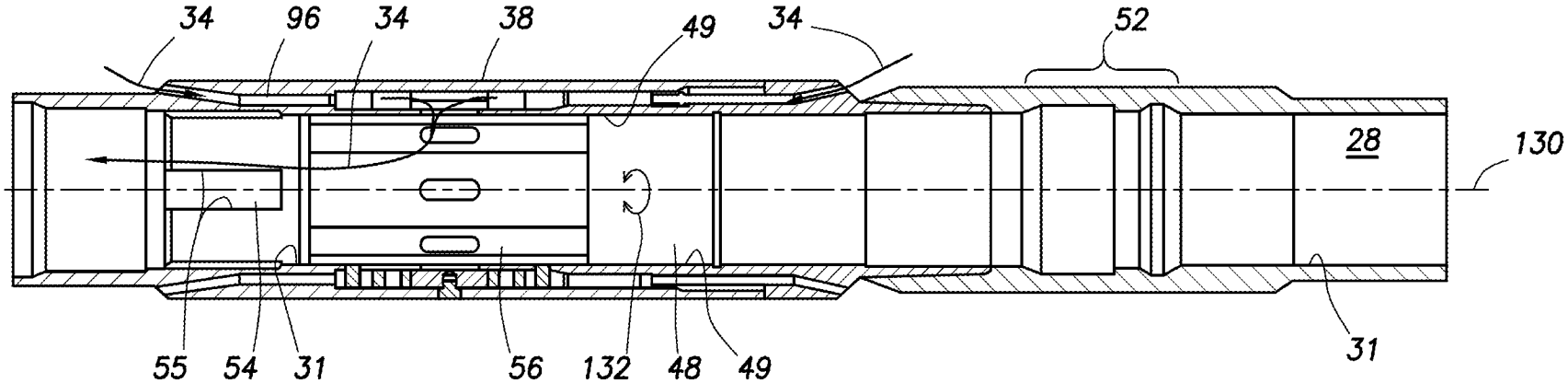

FIGS. 3A, 4A depict inflow control devices 30 in a fully closed position with fluid flow being prevented through ports 96. The rotary actuator 40 is not shown in these figures for clarity. The closure member 48 of each device 30 can be generally cylindrical in shape, and can rotate relative to an outer housing 38 of the device 30. The closure member 48 can have any shape so that it can be rotated to actuate the inflow control device 30. For example, FIG. 3A shows a closure member 48 with a portion that is conically shaped. When the stationary member 44 and drive member 42 of the rotary actuator 40 engage the first and second recesses 54, 56, respectively, the rotary actuator 40 can actuate the inflow control device 30 to a desired position (e.g., open or partially open) by rotating the drive member 42 relative to the stationary member 44. The rotation of the drive member 42 rotates the closure member 48 relative to the outer housing 38, thereby actuating the device 30. FIGS. 3B, 4B depict inflow control devices 30 in a fully open position with fluid flow permitted through ports 96 as indicated by arrows 34.

Figure 2:
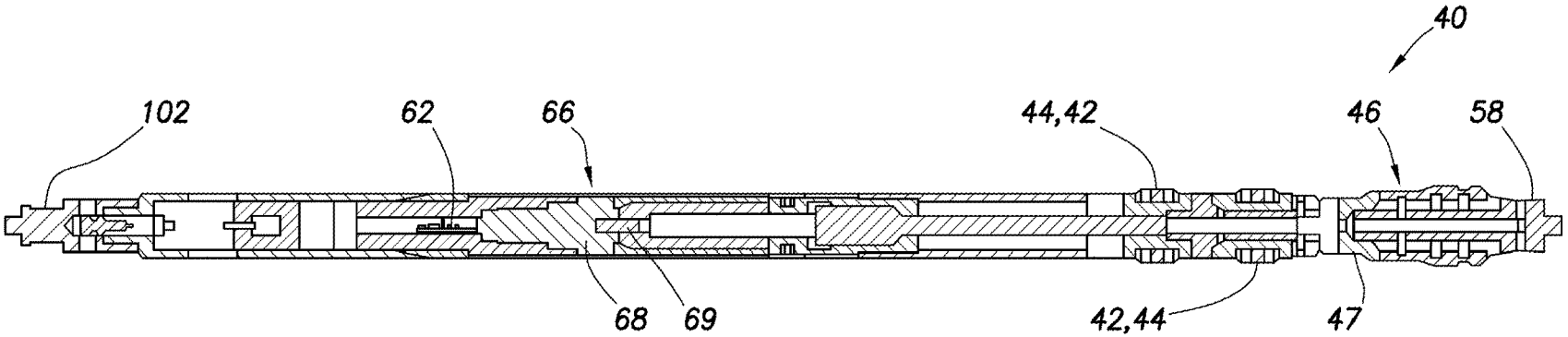
FIG. 2 depicts a cross-sectional view of the rotary actuator.

Please note that the first recess 54 is shown upstream from the second recess 56 in FIGS. 3A-B, while the first recess 54 is shown downstream from the second recess 56 in FIGS. 4A-B. Also, the rotary actuator 40 is shown in FIG. 2 as having the stationary member 44 and drive member 42 in either the upstream or downstream positions. If one of the stationary and drive members 44, 42 is positioned at the downstream position (left in the drawing) then the other one will be positioned at the upstream position (right in the drawing). This illustrates that the first and second recesses 54, 56, as well as the stationary and drive members 44, 42, can be in any configuration, as long as the first and second recesses 54, 56 are mated to the desired stationary and drive members 44, 42.

The inflow control device 30 in FIGS. 4A-B is depicted as including the locator profile 52 in an inner wall 31 of the device 30, where the profile 52 can engage with the locator device 46 and anchor the rotary actuator 40 at the predetermined location. However, it is not necessary that the profile 52 be included with the inflow control device 30. Alternatively, or in addition to, the profile 52 can be included in an inner wall 25 of the tubing string 24 as indicated in intervals 16, 17, 19 in FIG. 1.

Figure 5A:
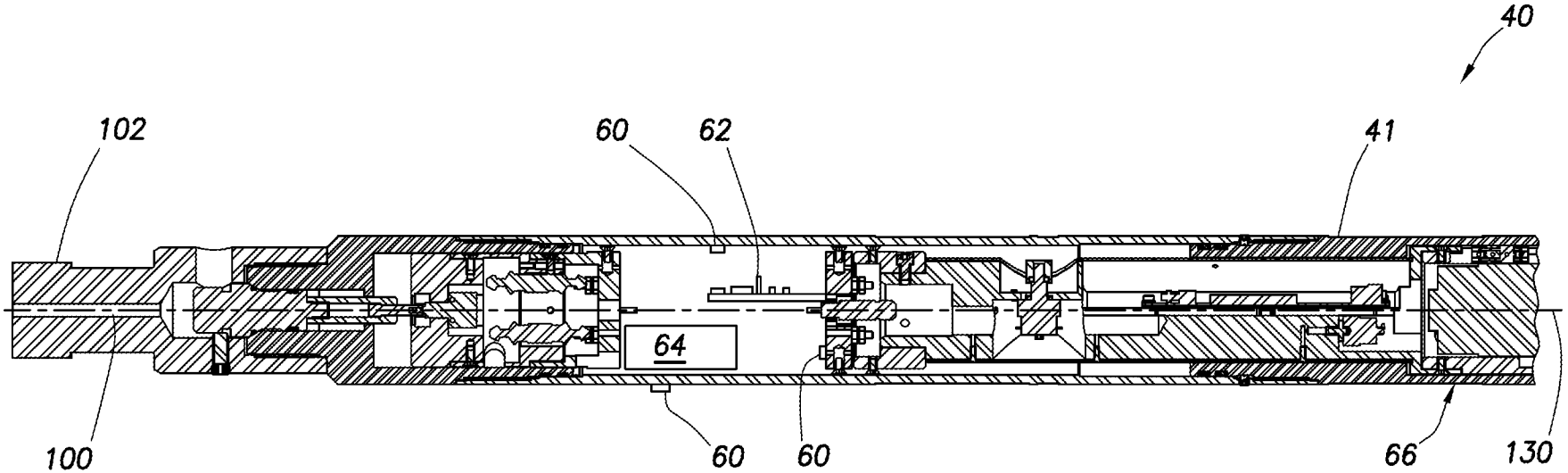
FIGS. 5A-C depict detailed partial cross-sectional views of the rotary actuator.
Figure 5B:
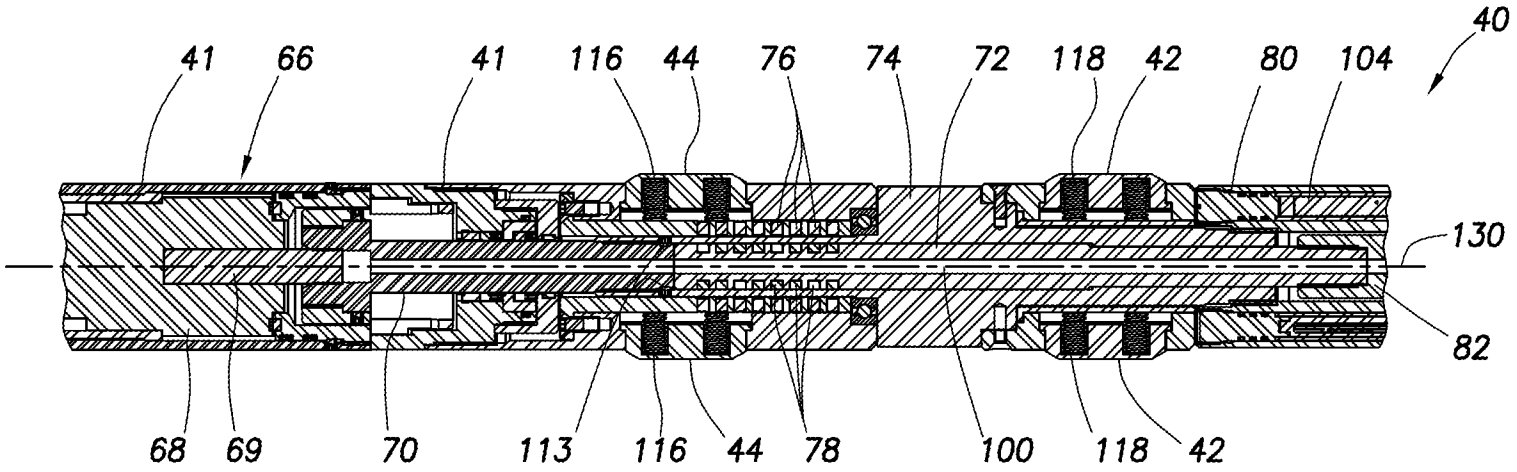
Figure 5C:
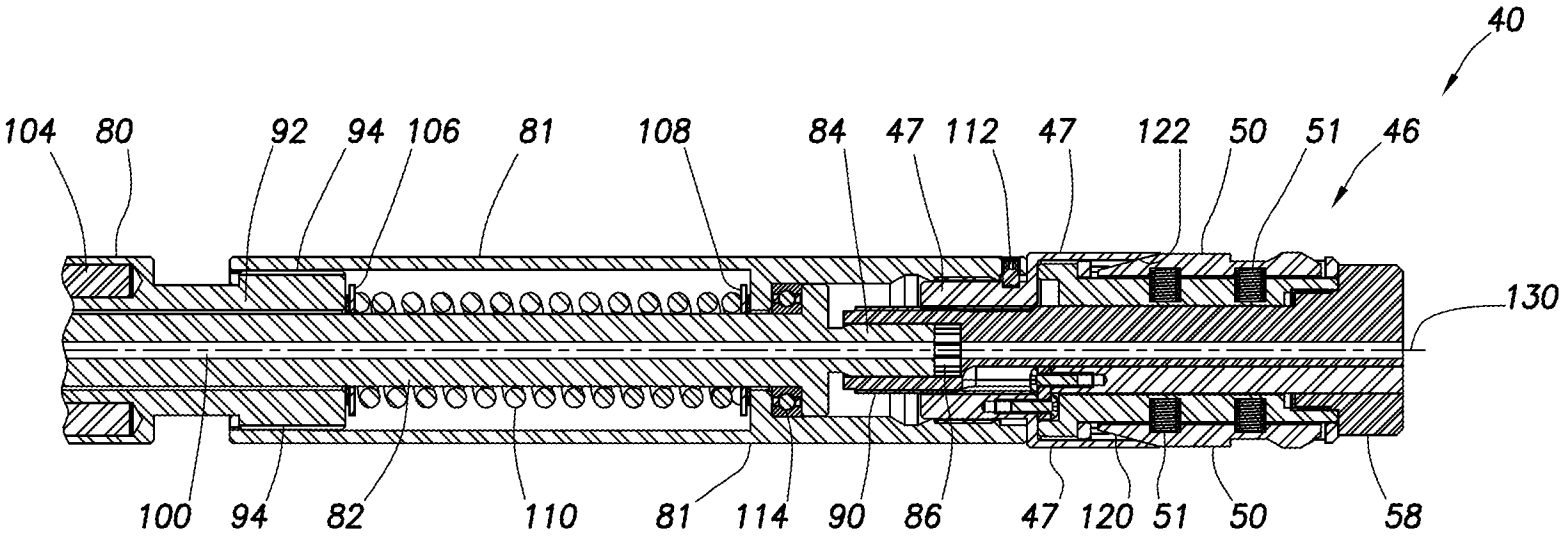

Referring now to FIGS. 5A-C, a more detailed discussion of the operation of a certain embodiment of the rotary actuator 40 is provided. FIG. 5A is a downstream portion (i.e., closer to the wellhead for production operations), FIG. 5B is an intermediate portion, and FIG. 5C is an upstream portion of the rotary actuator 40. FIG. 5A depicts the controller 62 in a chamber that can also include an optional battery 64 for powering the controller 62, the sensors 60, and/or the motor 66, if necessary. However, power for operating the rotary actuator 40 is preferably supplied through a wired connection made at the coupling 102, which couples the rotary actuator 40 to the conveyance 32. Wires may be positioned in an internal passage 100 that extends through the rotary actuator 40 to distribute control and power to the components of the actuator 40.

FIG. 5B depicts a motor 66 with a rotor 69 and a stator 68, where the rotor 69 can rotate about the axis 130 in either clockwise or counter-clockwise directions to operate the rotary actuator 40. The stator 68 is rotationally fixed to an outer housing 41 of the rotary actuator 40, which prevents relative rotation between the stator 68 and outer housing 41. The outer housing 41 is also rotationally fixed to the stationary member 44, which prevents relative rotation between the outer housing 41 and the stationary member 44. The stationary member 44 includes a first magnetic device 76 that magnetically couples the stationary member 44 to a second magnetic device 78, which is included in an inner sleeve 72. The first and second magnetic devices 76, 78 can include one or more magnets that provide a sufficient magnetic coupling force to rotationally fix the stationary member 44 to the inner sleeve 72, thereby preventing relative rotation between the stationary member 44 and the inner sleeve 72. Magnetic flux lines of the magnetic coupling between the first and second magnetic devices 76, 78 extend through an intermediate sleeve 74, which is positioned between the stationary member 44 and the inner sleeve 74.

The intermediate sleeve 74 is permitted to rotate relative to the stationary member 44 without causing the inner sleeve 72 to rotate relative to the stationary member 44. The inner sleeve 72 is rotationally fixed (e.g., via a threaded connection) to another inner sleeve 82, which extends through the rotary actuator 40 to a nose 58 of the locator device 46. The inner sleeve 82 is rotationally fixed to the nose 58 via engagement of a splined nose 84 of the inner sleeve 82 with a splined recess 86 of the nose 58. The engagement of the splined nose 84 with the splined recess 86 allows longitudinal movement between the nose 84 and recess 86 while transferring torque between the nose 84 and recess 86. The nose 58 is rotationally fixed to engagement members 50 which are selectively extended and retracted to anchor and release the rotary actuator 40 to or from the predetermined location in the tubing string 24. Therefore, the nose 58 and engagement members 50 do not rotate relative to the stator 68 or stationary member 44. When the stationary member 44 is engaged with the first recess 54, then the stator 68, the outer housing 41, the stationary member 44, the first magnetic device 76, the second magnetic device 78, the inner sleeve 72, the inner sleeve 82, the nose 58, and the engagement members 50 are rotationally fixed to the tubing string 24.

The rotor 69 is rotationally fixed to a drive shaft 70, which rotates with the rotor 69 when the rotor 69 rotates. The drive shaft 70 is rotationally fixed to the intermediate sleeve 74 via a fastener 113 that connects the shaft 70 to the sleeve 74. The inner sleeve 74 is rotationally fixed to the drive member 42 and the outer sleeve 80, where the drive member and the outer sleeve 80 rotates with the rotor 69 when the rotor 69 rotates. One end of the sleeve 80 is a splined nose 92 which engages a splined recess 94 in the outer sleeve 81. The splines on the nose 92 and recess 94 allow longitudinal movement between the nose 92 and recess 94 while transferring torque between the nose 92 and recess 94. Therefore, the outer sleeve 80 is rotationally fixed to the outer sleeve 81 as long as the splined nose 92 is engaged with the splined recess 94. If longitudinal displacement of the splined nose 92 is sufficient to disengage the splined nose 92 from the splined recess 94, then the outer sleeve 80 would no longer be rotationally fixed with the outer sleeve 81, thereby allowing relative rotation between these outer sleeves 80, 81. The outer sleeve 81 is rotationally fixed to a threaded sleeve 47 via a fastener 112. Therefore, when the rotor 69 rotates about the axis 130, then the drive shaft 70, the intermediate sleeve 74, the drive member 42, and the outer sleeve 80 rotate with the rotor 69. When the splined nose 92 is engaged with the splined recess 94, then the rotating outer sleeve 81 and threaded sleeve 47 also rotate with the rotor 69. When the splined nose 92 is disengaged from the splined recess 94, then the rotating outer sleeve 81 and threaded sleeve 47 do not rotate with the rotor 69.

The threaded sleeve 47 is threaded onto the nose 58 via threads 90. Initially, the threaded sleeve 47 is threaded onto the nose 58 such that the inclined surfaces 120 on the engagement members 50 engage with the mating inclined surface 122 on the threaded sleeve 47, thereby forcing the engagement members 50 to be retracted radially inward. These engagement members 50 can be retracted during run-in and during movement of the rotary actuator between locations in the tubing string 24. When the rotary actuator 40 is positioned at or near the predetermined location, these engagement members 50 can be extended to enable engagement of the members 50 with a locator profile 52.

Figure 6:
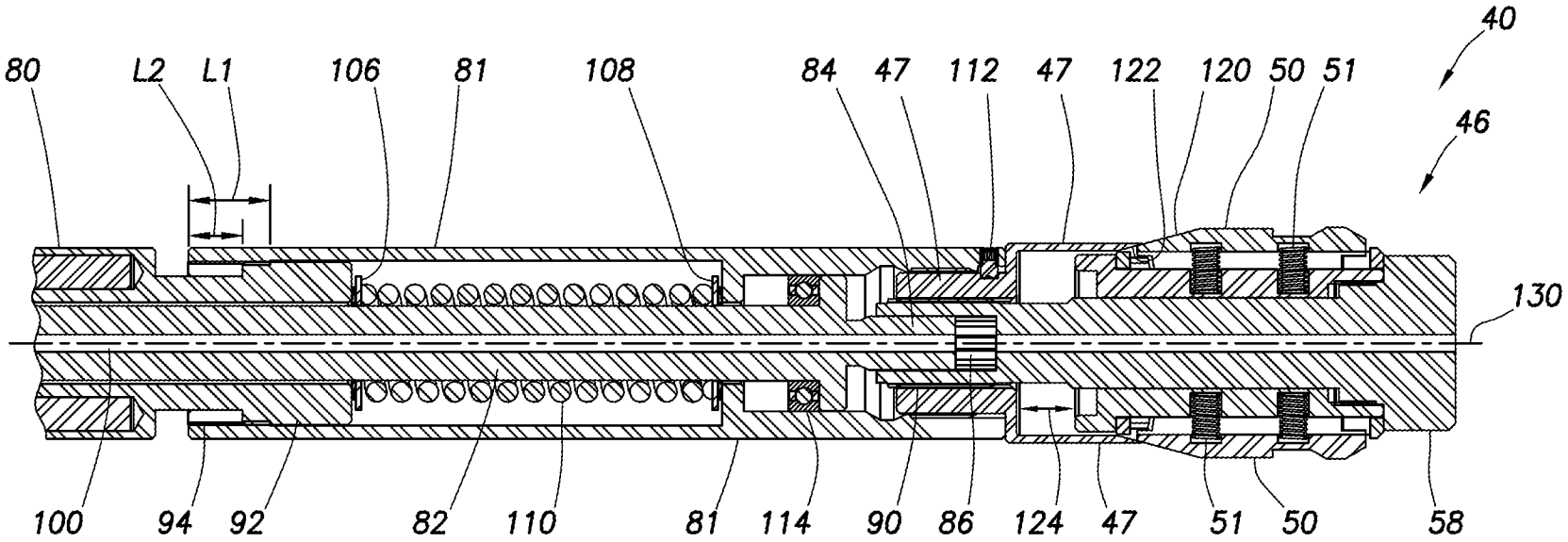
FIGS. 6 and 7 depict detailed partial cross-sectional views of a lower portion of the rotary actuator in various states of operation.

Referring now to FIG. 6, when the engagement members 50 of the locator device 46 are retracted and the rotary actuator 40 is positioned at or near the predetermined location, the motor 66 can be energized to rotate the rotor 69 in a first direction (e.g., clockwise). The biasing device 110 ensures that the splined nose 92 is initially engaged with splined recess 94 during run-in. Therefore, rotation of the rotor 69 will rotate the intermediate sleeve 74, which will rotate the drive member 42 and the outer sleeve 80, which will rotate the outer sleeve 81 through the engagement of the splined nose 92 with the splined recess 94. A bearing 114 can be positioned between the rotating outer sleeve 81 and the inner non-rotating sleeve 82 to facilitate the relative rotation between these sleeves 81, 82. The rotation of the outer sleeve 81 will rotate the threaded sleeve 47, thereby longitudinally moving the threaded sleeve 47 away from the engagement members 50 due to the rotation of the threaded sleeve 47 about the threads 90. This longitudinal movement of the threaded sleeve 47 (see arrows 124) can disengage the inclined surfaces 120 of the engagement members 50 from the mating inclined surface 122. This disengagement allows radial outward extension of the members 50 by the biasing devices 51 and allows the members 50 to engage a profile 52 at the predetermined location.

Figure 7:
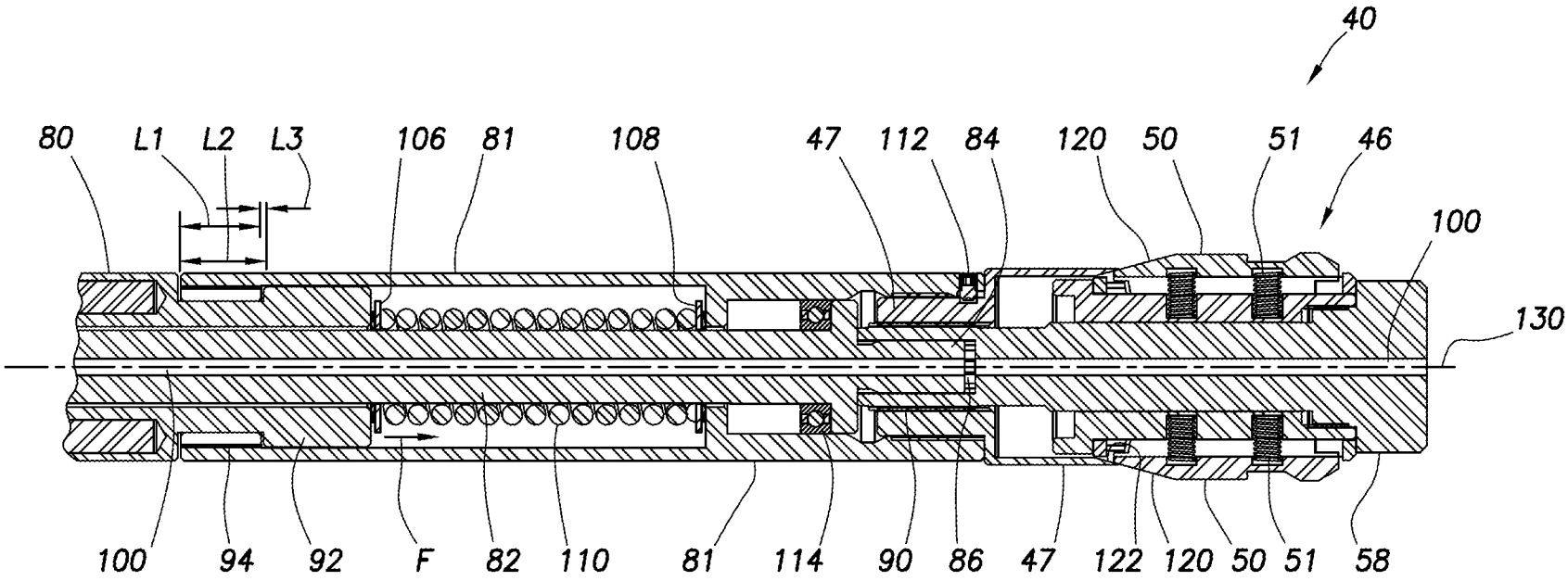

FIG. 6 depicts a longitudinal movement of the threaded sleeve 47 and the outer sleeve 81 by a length L2. The length of the splines in the splined recess 94 is given as length L1. When the length L2 exceeds the length L1, then the splined nose 92 will be disengaged from the splined recess 94, as seen in FIG. 7. When the engagement members 50 engage the profile 52, the rotary actuator 40 is anchored at the predetermined location. To disengage the splined nose 92 from the splined recess 94, a compressive force F can be applied to the rotary actuator 40, thereby compressing the actuator 40 against the profile 52. This compression of actuator 40 compresses the biasing device 110 between two thrust bearings 106, 108 and increases the length L2 such that it exceeds the length L1 by a gap L3, thereby disengaging the splined nose 92 from the splined recess 94. This disengagement allows the upper portions of the rotary actuator 40 to rotate as needed for actuating an inflow control device 30 without causing rotation of the outer sleeve 81 or threaded sleeve 47, thus preventing disengagement of the engagement members 50 from the profile 52.

When it is desired to move the rotary actuator 40 to another inflow control device 30 in the tubing string, disengagement of the engagement members 50 from the locator profile 52 may be necessary. To disengage the members 50 from the profile 52, the force F is released which allows the biasing spring 110 to once again cause engagement between the splined nose 92 and splined recess 94, as seen in FIG. 6. Once the splined nose 92 is engaged with the splined recess 94, rotation of the rotor 69 in a second direction (e.g., counter-clockwise), which is opposite the first direction, will cause the threaded sleeve 47 to move longitudinally (see arrows 124 in FIG. 6) as the threaded sleeve is threaded along threads 90. The longitudinal movement of the threaded sleeve 47 will once again engage the inclined surfaces 120 of the engagement members 50 with the mated inclined surface 122 of the threaded sleeve 47, thereby causing the members 50 to retract radially and disengage from the locator profile 52.

It should be clearly understood that even though the locator device 46 may be preferred when operating the rotary actuator 40, it is not necessary that the locator device 47 is used at all. The rotary actuation of inflow control devices 30 by the rotary actuator 40 can still be performed without using the locator device 47 to locate the rotary actuator at the predetermined location in the tubing string 24. It should also be clearly understood that many other configurations of the locator device 46 can be used instead of the example given above. For example, extendable dogs, keys, and/or lugs may be used to selectively engage another profile 52. A locking mandrel type device can also be used, as well as an active anchoring system.

The rotary actuator 40 may be moved to any inflow control device 30 in the tubing string 24 or any other tubing strings 24 that can be installed in lateral wellbores. To enter a tubing string 24 in a lateral wellbore, a guide nose can be installed on the nose 58 to selectively cause the rotary actuator 40 to enter a tubing string 24 in a lateral wellbore. Many configurations of a guide nose are available for this purpose, so the guide nose will not be discussed further.

Referring again to FIG. 5B, when referring to the stationary member 44 or the drive member 42, it should be clearly understood that each member 44, 42 can include multiple members 44, 42, respectively, and that each member can engage with a selected one of the recesses. Therefore, there can be multiple first recesses 54 to engage with multiple stationary members 44, and multiple second recesses 56 to engage with multiple drive members 42. With the rotary actuator 40 at the predetermined location in the tubing string, the stationary and drive members 44, 42 will be correctly positioned longitudinally in the tubing string 24 with the first and second recesses 54, 56, respectively. The rotary actuator 40 may need to be rotated slightly to engage the stationary member 44 with the first recess 54, and the drive member 42 with the second recess 56. Once engaged, the stationary member 44 is rotationally fixed to the first recess 54, and the drive member 42 is rotationally fixed to the second recess 56. The members 44, 42 can be disengaged from the recesses 54, 56 by merely moving the rotary actuator 40 longitudinally away from the recesses 54, 56. The biasing devices 116, 118 allow the members 44, 42 to retract as needed as the rotary actuator travels through the tubing string 24. However, if the locator device 46 is used, then it must be disengaged to allow the rotary actuator 40 to move further into the tubing string 24.

If the orientation of the inflow control device 30 is also known, then the position of the closure member 48 of the device 30 is known when the drive member 42 engages the recess 56. However, if the orientation of the device 30 is not known, then it can be determined by various ways. For example, the drive member 42 can rotate the closure member 48 to its stops in one direction, record the orientation of the drive member 42, then rotate the closure member 48 to its stops in an opposite direction, and record the orientation of the drive member 42. This would provide the complete range of the closure member 48 for the device 30 at that location from fully closed to fully open positions. Additionally, orientation sensors 60 can be used to determine the orientation of the rotary actuator 40, and once the stationary and drive members 44, 42 are engaged with the respective recesses 54, 56, the orientation of the device 30 at that location can be determined.

The rotary actuator 40 can be used to individually adjust inflow control devices 30 in a tubing string 24. The inflow control devices can be adjusted to open, close, or partially open individual inflow control devices. For example, if water is being produced from a wellbore interval 19, then the rotary actuator 40 can be deployed to close the inflow control device 30 in the internal 19 to prevent water production from that zone. If a higher velocity fluid is being produced from or injected into a wellbore interval, then the rotary actuator 40 can be deployed to further restrict flow through the inflow control device 30 at the internal to reduce the fluid velocity, if desired. If a higher grade oil is being produced from wellbore interval 17 than the oil being produced from either one of the intervals 16 or 18, then the rotary actuator can be moved between the inflow control devices 30 in these intervals to reduce flow restriction to flow from interval 17 while increasing a restriction to flow from the intervals 16 and 18. Additionally, if a wellbore 11 in the well system 10 is being used for steam injection treatment of the formation 20, then the rotary actuator 40 can be moved between the multiple inflow control devices 30 in wellbore 11 to individually vary flow restrictions through these devices 30 into the formation to control a steam front as it progresses through the formation 20. The rotary actuator 40 can be used to move between one or more of the inflow control devices to adjust the flow rates of fluid flowing through each of the inflow control devices. In this manner, the desired flow rate in each zone can be more effectively managed using the same tool to adjust the flow rates.

Therefore, the present system is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. As used herein, the words "comprise," "have," "include," and all grammatical variations thereof are each intended to have an open, non-limiting meaning that does not exclude additional elements or steps. While compositions and methods are described in terms of "comprising," "containing," or "including" various components or steps, the compositions and methods also can "consist essentially of" or "consist of" the various components and steps.

Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A rotary actuator that adjusts an inflow control device in a tubing string, the rotary actuator comprising:

a stationary member;

a drive member, wherein the drive member rotates relative to the stationary member, and the drive member adjusts the inflow control device in response to the rotation of the drive member;

a locator device that anchors the rotary actuator at a predetermined location in the tubing string;

an intermediate sleeve; and an inner sleeve, wherein the inner sleeve is positioned radially inward from the stationary member, and the intermediate sleeve is positioned radially between the stationary member and the inner sleeve, wherein a first magnetic device in the stationary member is magnetically coupled to a second magnetic device in the inner sleeve.

2. The actuator according to claim 1, wherein the stationary member engages a first recess, wherein the engagement with the first recess substantially prevents relative rotation between the stationary member and the tubing string, wherein the drive member engages a second recess, and wherein the second recess rotates with the drive member when the drive member is rotated relative to the tubing string.

3. The actuator according to claim 2, wherein the first recess is in an inner wall of at least one of the inflow control device and the tubing string, and wherein the second recess is in an inner wall of a closure member of the inflow control device.

4. The actuator according to claim 3, wherein the rotation of the drive member rotates the closure member and wherein the inflow control device is selectively operated between closed, open, and partially open positions in response to the rotation of the closure member.

5. The actuator according to claim 1, wherein the rotary actuator further comprises a motor, and wherein the motor rotates the drive member relative to the stationary member.

6. The actuator according to claim 1, wherein the locator device includes a threaded sleeve and engagement members, and wherein rotation of the threaded sleeve selectively extends and retracts the engagement members.

7. The actuator according to claim 1, wherein the locator device further comprises engagement members that engage a locator profile in an inner wall of at least one of the inflow control device and the tubing string when the engagement members are extended, and wherein the engagement between the engagement members and the locator profile anchors the rotary actuator at the predetermined location.

8. The actuator according to claim 1, wherein the magnetic coupling prevents relative rotation between the stationary member and the inner sleeve, and wherein the intermediate sleeve rotates relative to the inner sleeve when the drive member rotates.

9. The actuator according to claim 1, wherein the rotary actuator further comprises at least one sensor that detects an identifier of the inflow control device and transmits the detected identifier to a controller, wherein the controller compares the detected identifier to an expected identifier and validates that the rotary actuator is at the predetermined location when the detected identifier matches the expected identifier.

10. The actuator according to claim 1, wherein a longitudinal flow passage extends through the tubing string, and wherein the rotary actuator further comprises at least one sensor that detects at least one characteristic of a fluid that flows through the longitudinal flow passage.

11. The actuator according to claim 10, wherein the rotary actuator operates the inflow control device in response to the detected fluid characteristic.

12. The actuator according to claim 1, wherein the rotary actuator further comprises at least one sensor that detects the azimuthal orientation of the stationary member.

13. A method of adjusting an inflow control device in a tubing string with a rotary actuator, the method comprising:

conveying the rotary actuator to a predetermined location in the tubing string, wherein the rotary actuator comprises:

(A) a stationary member;

(B) a drive member;

(C) a locator device with engagement members; and (D) an inner sleeve, wherein the inner sleeve is positioned radially inward from the stationary member, wherein a first magnetic device in the stationary member is magnetically coupled to a second magnetic device in the inner sleeve;

engaging the engagement members with a profile in at least one of the inflow control device and the tubing string, wherein the engagement prevents further longitudinal movement of the rotary actuator into the tubing string;

engaging the stationary member with a first recess in at least one of the inflow control device and the tubing string, and preventing relative rotation between the stationary member and the tubing string when the stationary member abuts a wall of the first recess; and rotating the drive member relative to the stationary member, thereby adjusting the inflow control device.

14. The method according to claim 13, wherein the step of conveying further comprises conveying the rotary actuator near a predetermined location in the tubing string, radially outwardly extending the engagement members, and then moving the rotary actuator to the predetermined location.

15. The method according to claim 13, the method further comprising engaging the drive member with a second recess in a closure member of the inflow control device, thereby rotating the closure member when the drive member rotates relative to the tubing string.

16. The method according to claim 15, wherein the step of rotating the closure member further comprises selectively operating the inflow control device between closed, open, and partially open positions in response to the rotation of the closure member.

17. The method according to claim 13, wherein the rotary actuator further comprises at least one sensor, and wherein the method further comprises:

detecting an identifier of the inflow control device with the sensor; and transmitting the detected identifier to a controller, wherein the controller compares the detected identifier to an expected identifier and validates that the rotary actuator is at the predetermined location when the detected identifier matches the expected identifier.

18. The method according to claim 13, wherein the rotary actuator further comprises at least one sensor, and wherein the method further comprises:

detecting at least one characteristic of a fluid that flows through a longitudinal flow passage of the tubing string; and adjusting the inflow control device in response to the detection.

* * * * *